United States Patent [19]

McCarthy

[11] 4,434,898

[45] Mar. 6, 1984

[54] CLOTHESLINE MAST

[76] Inventor: Patrick J. McCarthy, P.O. Box 5053, Hamilton, New Zealand

[21] Appl. No.: 327,918

[22] Filed: Dec. 7, 1981

[30] Foreign Application Priority Data

Dec. 9, 1980 [NZ] New Zealand ..... 195779

[51] Int. Cl.³ ..... A47F 5/00

[52] U.S. Cl. ..... 211/1.3; 211/119.01

[58] Field of Search ..... 211/1.3, 119.03, 207, 211/119.01

[56] References Cited

U.S. PATENT DOCUMENTS 2,594,158 4/1952 Hannameger ..... 211/119.01 X 2,784,848 3/1957 Senne ..... 211/1.3 X 4,206,847 6/1980 Brink ..... 211/1.3

4,225,048 9/1980 Hildreth ..... 211/1.3

*Primary Examiner*—Ramon S. Britts

*Assistant Examiner*—Robert W. Gibson, Jr.

*Attorney, Agent, or Firm*—Pearne, Gordon, Sessions, McCoy, Granger & Tilberry

[57] ABSTRACT

A clothes line has a pair of retractable masts (10,11) telescopically mounted within sunken casings and raised by fluid pressure. Cross-head (14) is detachably connected to mast (11), whilst cross-head (12) is connected to mast (10) and stored within a box member (26) when mast (10) is retracted.

1 Claim, 2 Drawing Figures

CLOTHESLINE MAST

This invention relates to a clothes line mast, and has particular application to clothes lines having a plurality of adjacent spaced apart parallel lines extending between and mounted on two spaced apart supports.

The intention of this invention is to provide a clothes line of the aforesaid kind, wherein, in known manner, the lines are detachable from one support and storable, by coiling on the other support. Additionally, by this invention it is intended to provide that at least one of the supports is retractable, thus enabling further utilisation of the site when the clothes line is not in use.

According to one aspect of this invention, there is provided a clothes line mast including a column telescopically mounted within a casing, said casing being adapted to be sunken in situ, sealing means mounted on the column adjacent the lower end thereof, a pressurized fluid connection means at the lower end of the casing, a hollow box member attached to the upper end of said casing, said box member having an open top and an aperture in its base through which said column can protrude, a cover plate attached to said column and capable of covering said box member, means for mounting a clothes line cross-head to said column whereby said mounting means and/or said clothes line cross-head can be contained within said box member when said column is retracted into said casing.

Other aspects of this invention which should be considered in all its novel aspects, will become apparent from the following description, which is given by way of example only, with reference to the accompanying drawings, in which.

Figure 1:
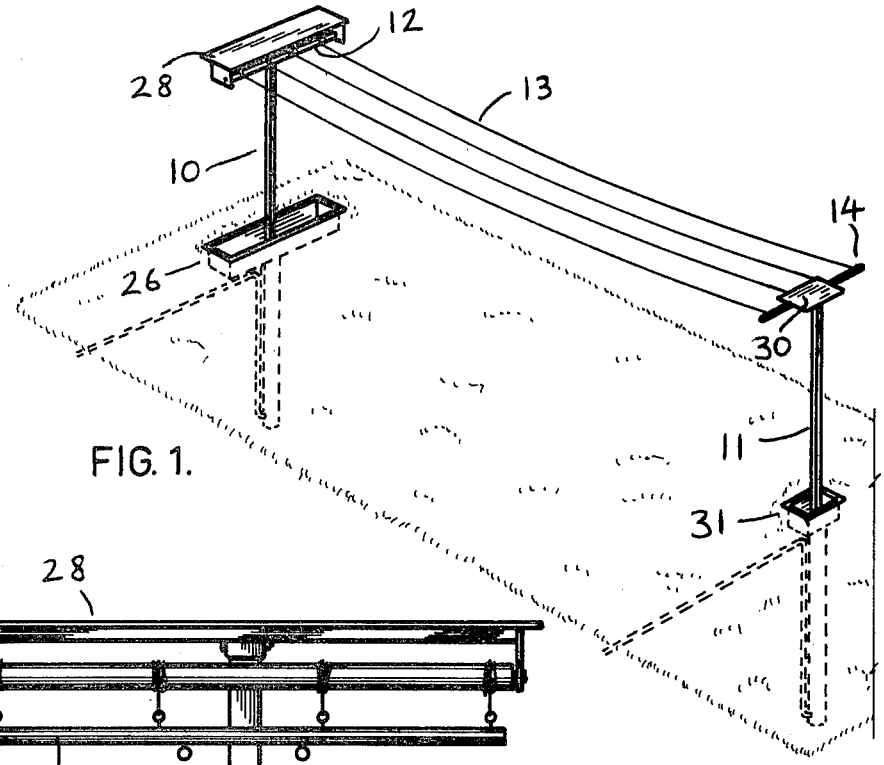
FIG. 1 illustrates a clothesline mounted between a pair of retractable clothes line masts.

A pair of masts 10 and 11 are illustrated in FIG. 1. Each mast is retractable within a support housing. Mounted on mast 10, there is a conventional clothes line cross-head 12 having a plurality of parallel clothes lines 13 extendable therefrom and attached to a further cross-head 14. This is detachably to the top of clothes line mast 11. and this connection may be affected by a hook member or members attached to the top of mast 11. Thus the cross-head 14 can be detached from the mast 11, and retracted and coiled about cross-head 12. The cross-head 12 is preferably spring loaded so as to recoil and rewind the lines 13 when the cross-head 14 is released from mast 11.

Although two masts are shown in FIG. 1, it will be appreciated that one such mast can be provided with the other clothes line support being mounted on the side of a building or the like.

Figure 2:
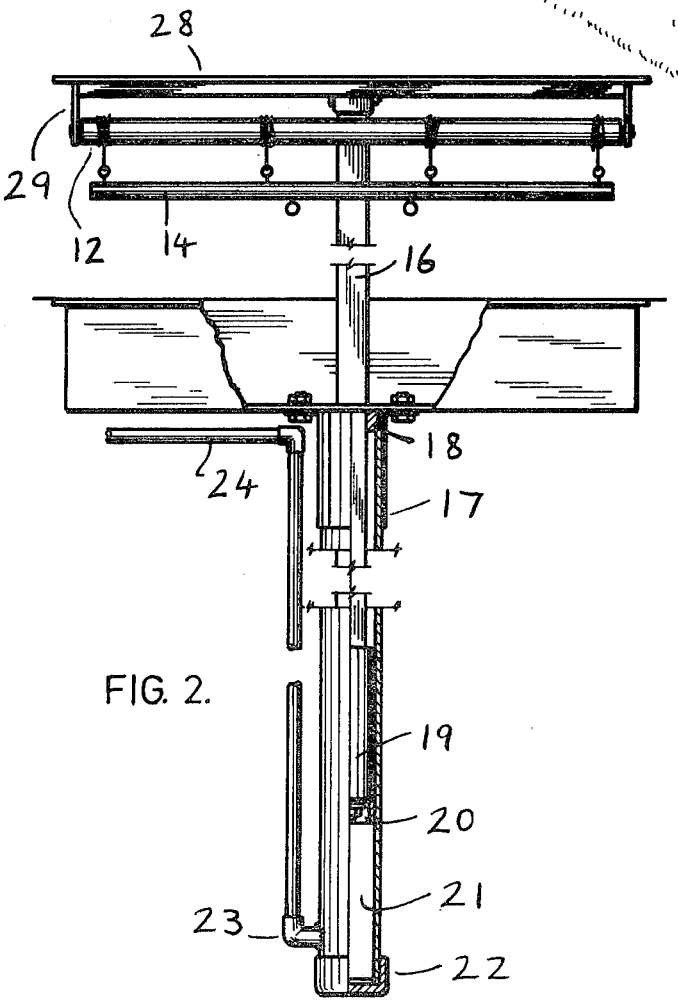
FIG. 2 illustrates a detailed view of the masts of FIG. 1.

Turning now to FIG. 2, the clothes line mast 10 will be described in detail. This has a column 16 telescopically mounted in a casing 17. Conveniently, the column 16 is of rectangular cross-section and moves within a guide member 18 at the top of the casing. At the bottom of the column, a piston member 19 is provided, to guide the column within the casing. This may be provided with a fluid seal 20 which defines a substantially fluid-type chamber 21 between the bottom of the column and the bottom 22 of the casing. The bottom of the casing is closed by an end cap, and a fluid inlet 23 is provided adjacent the bottom of the casing. A fluid conduit 24 is provided alongside the column, and can be attached to an appropriate fluid pressure source. Conveniently, the fluid pressure source is mains water pressure, and the conduit 24 is connected thereto by an appropriate tap or valve. The tap or valve, not shown, preferably as provision for supplying water pressure to the conduit 24, and for disconnecting conduit from the mains water pressure, with provision to allow fluid to escape from conduit 24 as required.

Attached to the top of the casing 17 is an open topped box member 26. This has an aperture in the base thereof through which the column 16 protrudes.

Mounted on top of the column 16 is a cover plate 28 of such a size as to cover the top of the box 26.

Means for mounting a clothes line cross-head is provided, and this may be mounted directly onto the column 16 or mounted to the under side of the cover plate 28 as shown.

The cross-head 12 is shown attached to brackets 29 on the under side of the cover plate, whilst the cross-head 14 is shown in its retracted position ready to be pulled out and attached to the mast 11.

It will be noted that the cover plate 30 and box 31 associated with mast 11 are of smaller dimension than that associated with the mast 10. As the cross-head is not permanently attached to the mast 11, the cover plate and box member can be of smaller dimensions than is required to store the cross-head 12.

In use, the clothes line can be stored in its retracted position, with the cross-head 14 and cross-head 12 stored beneath cover plate 28 and within box member 26. This storage position is achieved when the column 16 is lowered into the casing 17, when fluid pressure is released from the chamber 21. The weight of the clothes line mast is such that it will descend under its own weight providing the source of fluid pressure is disconnected and the fluid allowed to escape from conduit 24. In its retracted position, the cover plate 28 can be flush with the ground with the clothes line stored out of sight.

When the clothes line is required for use, both masts 10 and 11 can be raised by applying fluid pressure to the lower portions of the casings, and thus the masts will be raised to their extended positions shown in FIG. 1.

Finally, it will be appreciated that various alterations or modifications may be made to the foregoing without departing from the scope of this invention as exemplified by the following claims.

I claim:

1. A clothes line system including a pair of spaced apart clothes line supports on one of which a plurality of clothes lines are storable and extendable therefrom in substantially parallel relationship for anchoring to the other of said supports, wherein at least one of the supports includes a clothes line mast having a column telescopically mounted within a casing, said casing being adapted to be sunken in situ, sealing means being mounted on the column adjacent the lower end thereof, a pressurized fluid connection means being located at the lower end of the casing, a hollow box member being attached to the upper end of said casing, said box member having an open top and an aperture in its base through which said column can protrude, a cover plate being attached to said column and capable of covering said box member, said mast further including means mounting a clothes line cross head to said column whereby said mounting means and/or said clothes line cross head can be contained within said box member when said column is retracted into said casing, said column being sunken into the ground so that when the mast is in its retracted position, it will be hidden by said cover plate.

* * * * *